US006007101A

United States Patent [19]

Pritchard et al.

[11] Patent Number: 6,007,101

[45] Date of Patent: Dec. 28, 1999

[54] STABILIZING SKEG DEVICE

[75] Inventors: John C. Pritchard; Lizlott Pritchard, both of Thousand Oaks, Calif.

[73] Assignee: Doink Incorporated, Thousand Oaks, Calif.

[21] Appl. No.: 08/922,855

[22] Filed: Sep. 3, 1997

[51] Int. Cl.[6] ..... A63C 7/10

[52] U.S. Cl. ..... 280/809; 280/605; 280/14.2

[58] Field of Search ..... 280/14.2, 28, 28.11, 280/604, 605, 606, 809

[56] References Cited

U.S. PATENT DOCUMENTS

| | | | |
|---|---|---|---|
| 4,116,455 | 9/1978 | Dotson | 280/14.2 |
| 4,896,893 | 1/1990 | Shumays et al. | 280/14.2 |
| 5,156,644 | 10/1992 | Koehler et al. | 280/14.2 |
| 5,161,810 | 11/1992 | DeCesare | 280/14.2 |
| 5,356,164 | 10/1994 | Ozburn | 280/14.2 |
| 5,816,602 | 10/1998 | Hagashi | 280/14.2 |

*Primary Examiner*—Richard M. Camby
*Attorney, Agent, or Firm*—David O'Reilly

[57] ABSTRACT

A skeg device and system and the like, for mounting on snowboards or skis to improve performance, maneuverability, tracking and balance. Skegs are designed to easily mount on snowboards, and has blades for controlling the snowboard path in a variety of snow conditions from powder, to hard snow, to ice. Each skeg is comprised of a mounting plate for easily installing the skegs on a snowboard and a blade rotably mounted on a shaft that is spring loaded. The spring loaded rotatable shaft allows the blades to deflect when engaging a hard surface to constantly self-adjust to snow conditions. Depth adjustment is provided by a thumbscrew that adjusts the rotational position of the shaft and thus, the depth that the blade extends below the surface of the snowboard. By rotating the thumbscrew, a rider can dial in the tracking of the blade on each skeg individually.

14 Claims, 4 Drawing Sheets

STABILIZING SKEG DEVICE

BACKGROUND OF THE INVENTION

1. Field of the Invention

This invention relates to an improved performance stabilizer for snowboards, and more particularly relates to skegs to improve the maneuverability, tracking and stability of snowboards, skis and the like.

2. Background Information

Snowboards have become increasingly popular in recent years. Their popularity is due to the fact that they are much easier to learn to use than skis, and are much more maneuverable.

In snowboarding, the rider stands on the board in bindings which allows the board to glide on the surface of the snow in either direction. That is, the snowboarder can be gliding over the snow, and then reverse the board 180° front-to-back. Such maneuverability enhances the enjoyment of snowboarding.

However, in snowboarding, as with skis, some surfaces are better than others for controlling the direction and balance. Snowboards perform particularly well on a variety of surfaces; soft snow to hard snow, and even ice. However, the maneuverability, as with skis, is more difficult on hard snow and ice because it is more difficult to "track" with the edges of the board into the surface of the snow. It would be advantageous if some type of stabilizing and tracking improvement could be provided for snowboards.

It is therefore, one object of the present invention to provide stabilizing skegs for snowboards.

Yet another object of the present invention is to provide spring loaded skegs for snowboards that constantly adjust to various snow conditions.

Yet another object of the present invention is to provide a skeg system for snowboards that feature a depth adjustment for the skeg blades.

Yet another object of the present invention is to provide a skeg system comprised of three skegs on each end of a snowboard that are easily installed with a pair of T-nuts for each skeg.

Yet another object of the present invention is to provide a skeg system that improves rider performance and stability when mounted on snowboards.

BRIEF DESCRIPTION OF THE INVENTION

The purpose of the present invention is to provide a skeg system for installation on snowboards and the like, that improves performance and stability. The skeg system, when installed, will improve balance, tracking, maneuverability and handling of a snowboard under all conditions; such as soft powdery snow, hard snow or ice.

Snowboards provide a wide, flat surface with sharp edges along the side for maneuverability. To improve the stability, maneuverability, handling and tracking, a skeg system has been devised for addition to snowboards. The skegs are comprised of a mounting plate that is mounted on the surface of the snowboard with a pair of T-nuts and a self-adjusting blade extending below the board that improves tracking and maneuverability.

The skegs are preferably constructed of ultra-lightweight aluminum alloy, and are formed with a rounded sharp blade that will substantially improve performance, handling and maneuverability from powder to hard packed snow. The semi-round blades are mounted on a shaft that is spring loaded to allow the skeg blade to constantly adjust to various snow conditions. Up to six skegs can be mounted on a snowboard. Four skegs may be mounted on the front and rear along the sides, while an additional two will be centrally located at each end to complement the side mounted skegs.

The skeg mounting plate includes a flange attached to the blade mounting shaft, having a threaded hole for receiving an adjustable thumbscrew. The thumbscrew allows a rider to adjust the depth of the skeg blade by simply turning the dial to control the tracking on either edge. The skegs are designed to fit all types of snowboards, or even skis, to provide maximum rider performance, maneuverability and stability. A variety of options are available. The skeg system could include only a pair of skegs center mounted, one or two skegs on each side or six skegs, three mounted both in front and rear of the snowboard.

The above and other novel features of the invention will be more fully understood from the following detailed description and the accompanying drawings, in which:

DETAILED DESCRIPTION OF THE INVENTION

Figures 1, 4, 5:
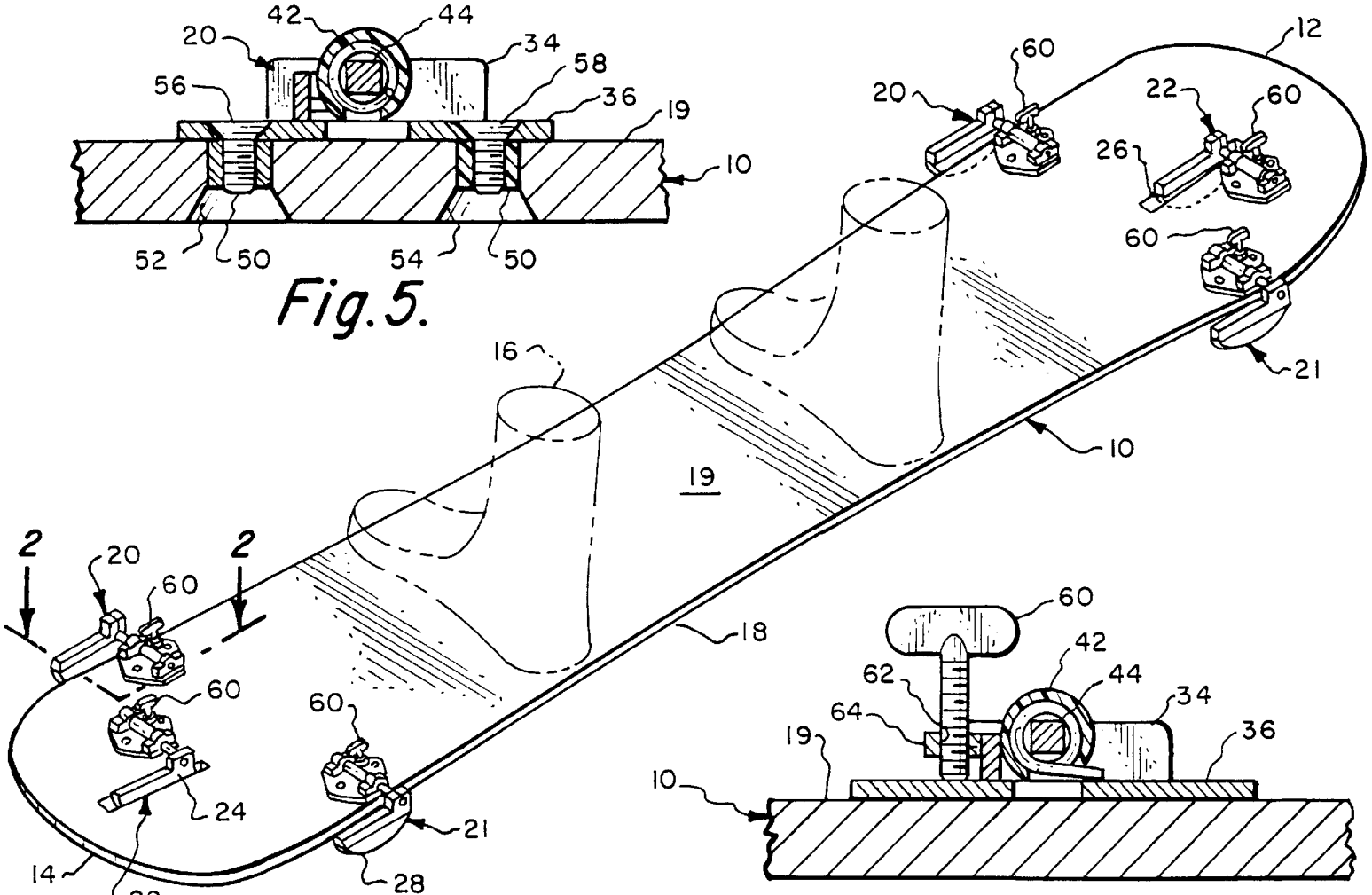
FIG. 1 is an isometric view of a snowboard with the skeg system installed.
FIG. 4 is a sectional view taken at 4—4 of FIG. 2.
FIG. 5 is a sectional view taken at 5—5 of FIG. 2.
Figure 2:
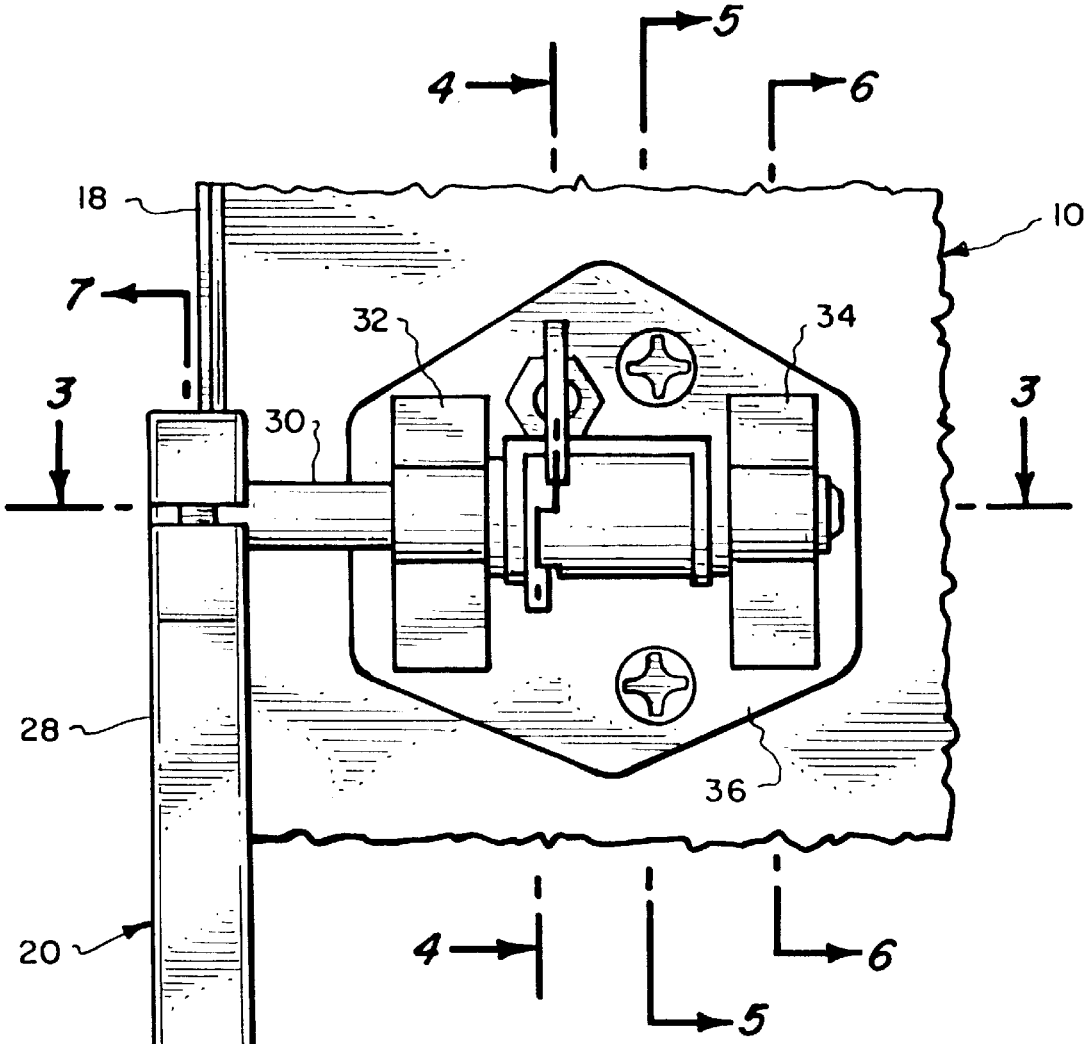
FIG. 2 is a sectional view taken at 2—2 of FIG. 1.
Figure 3:
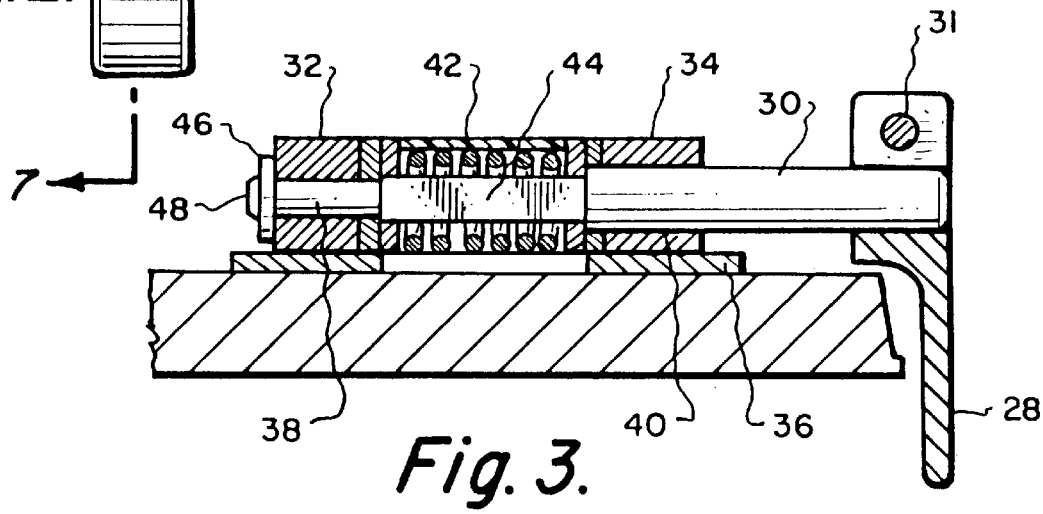
FIG. 3 is a sectional view taken at 3—3 of FIG. 2.

As illustrated in FIG. 1, a snowboard 10 has a forward end 12, and rear end 14 configured similar to the front end. Snowboard 10 is usually maneuvered in the snow by a rider (indicated in phantom at 16) tilting the board from edge to edge so it will "track" on the sharp edge 18. Rider 16 can also reverse the board so that it runs forward or backward.

Snowboards are popular because they are quite maneuverable under a wide variety of conditions. However, in spite of their greater maneuverability, it is difficult to get the edges 18 of snowboard 10 to "track" on hard snow or ice, and provide the stability and control desired. For this reason, the skegs 20, 21 and 22 have been designed to provide stability; improve tracking, balance, maneuverability and assist in keeping snowboard 10 "stable" when running over a surface.

Skegs 20, 21 and 22 are constructed to mount either on the edges 18 of snowboard 10, or in slots 24 and 26 cut in the center at the forward end 12 and rear end of snowboard 10. A wide variety of systems are available for rider 16. The system can includes one, or up to six skegs mounted on the forward end 12 and rear/or end 14 of snowboard 10 in any configuration desired. Preferably, at least two skegs 20 will be mounted on the rear edges of snowboard 10 with the front and center skegs being optional. For maximum maneuverability, a rider 16, however, should have a minimum of three skegs mounted at the rear of snowboard 10.

Skegs 20, 21 and 22 are shown in greater detail in FIGS. 2 through 8. Skeg 20 is comprised of a skeg blade 28, attached to shaft 30, mounted in shaft supports 32 and on mounting plate 36. Blade 28 is clamped on shaft 30 by Allen screw 31. This allows a damaged blade to be removed and easily replaced without having to replace entire skeg 20.

Shaft 30 is rotably mounted in sockets 38 and 40, in supports 32 and 34. Coil spring 42 is mounted around a square portion 44 of shaft 30. Coil spring 42 keeps blade 28 in an extended position, but allows the blade to deflect for constant self-adjustment to snow conditions. Shaft 30 is held in mounts 32 and 34 by C-washer 46, engaging slot 48 in the end of shaft 30.

Skegs 20, 21 and 22 are mounted on surface 19 of snowboard 10 by T-nuts 50, fitting sockets 52 and 54, receiving flat head bolts or screws 56 and 58 (as shown in FIG. 5). Skegs 20 and 21 are mounted on the outboard edges 18, and the rear end and forward end of snowboard 10 as shown in FIG. 1, with skegs 22 mounted in slots 24 and 26, cut into the surface 19 of snowboard 10 at the rear and forward ends respectively. Skegs 20, 21 and 22 are substantially identical in construction and designed to fit all types of snowboards; left side skegs 20 being a mirror image of right side skegs 21. They are easily installed with only two T-nuts and screws per side. Thus, the skegs 20, 21 and 22 can be easily fitted to any snowboard. While skegs 20 and 21 are described as being attached to snowboard 10, their design would allow them to be easily attached to skis as well, if desired.

All blades, on skeg 20, also includes a depth adjustment as illustrated in FIG. 4. Thumbscrew 60 allows rider 16 to "dial in" the depth of blade 28 to control tracking on either edge of snowboard 10 or through center slots 24 and 26. Thumbscrew 60 fits threaded hole 62 in flange 64, attached to shaft 30. Rotation of thumbscrew 60 raises or lowers flange 62 to raise or lower blade 28 on skeg 20. Thus, each skeg 20, 21 and 22 is separately and individually adjustable to control tracking according to snow conditions, slope of the course, etc. This allows rider 16 to have maximum performance, maneuverability, stability and tracking during a run.

Figure 6:
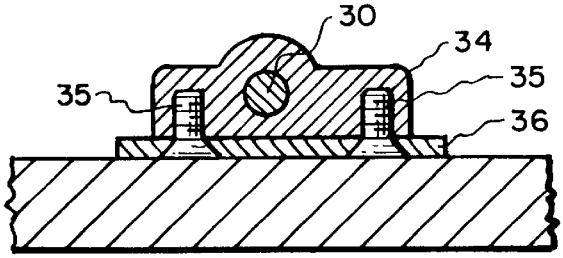
FIG. 6 is a sectional view taken at 6—6 of FIG. 2.

Shaft supports 32 and 34 for shaft 30 are secured to mounting plate 36 by flat head screws 35 as illustrated in FIG. 6. Optionally, shaft housings or supports 32 and 34 could be welded or integrally formed on plate 36, or milled from a solid piece of aluminum alloy or plastic.

Figure 7:
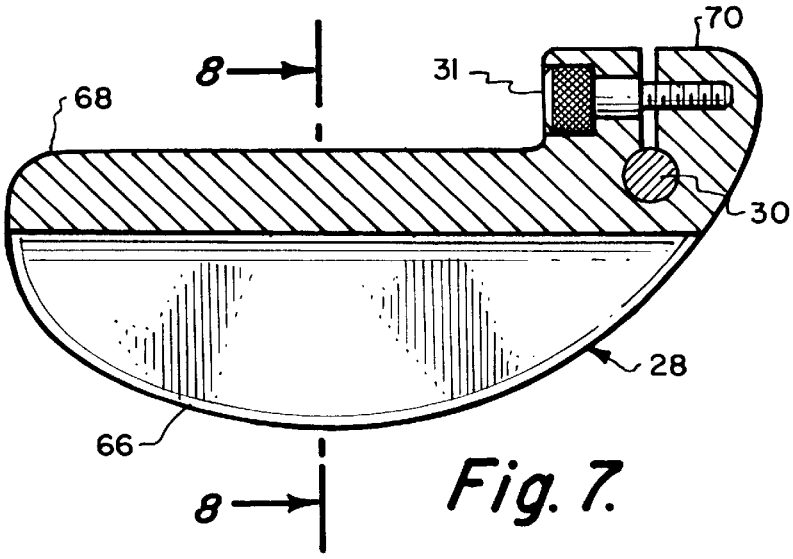
FIG. 7 is a sectional view illustrating the skeg blade taken at 7—7 of FIG. 2.
Figure 8:
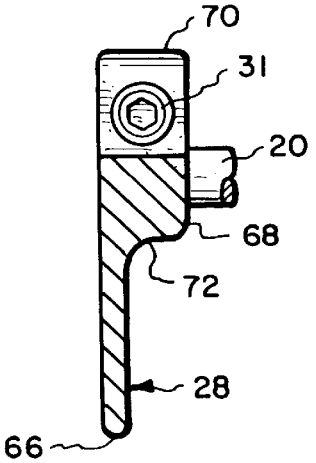
FIG. 8 is a sectional view illustrating the shape taken at 8—8 of FIG. 7.

The shape and configuration of blade 28 on skegs 20, 21 and 22 is illustrated in FIGS. 7 and 8. Blade 28 has a smooth, curved edge 66 to allow snowboard 10 to run in either direction. Blade 28 is formed on body 68, having a split boss 70 for receiving mounting screw 31 to clamp blade 28 on shaft 30. Body 68 tapers down at shoulder 72 to form blade 28.

Figure 9:
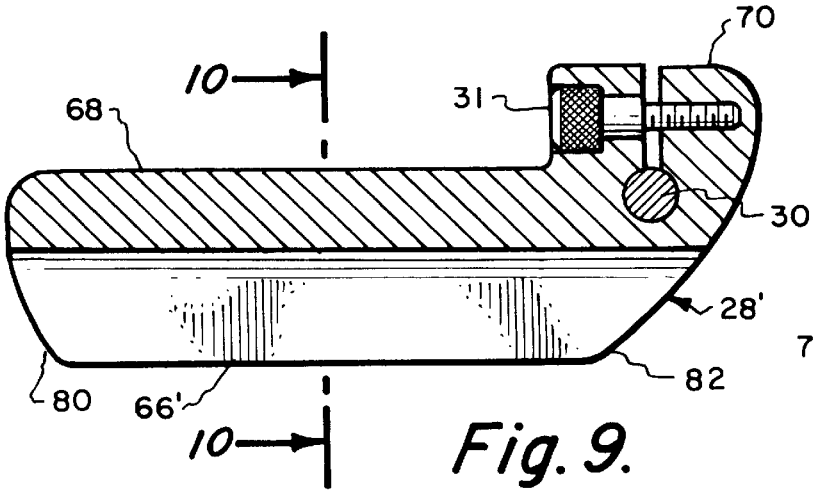
FIG. 9 is a sectional view similar to FIG. 7 illustrating an optional configuration of the skeg blade.
Figure 10:
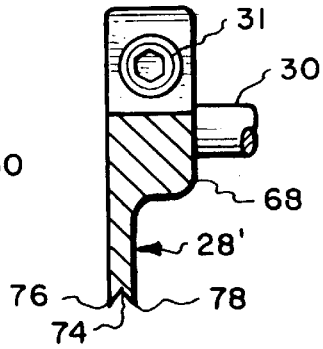
FIG. 10 is a sectional view illustrating the optional shape of the skeg blade taken at 10—10 of FIG. 9.

An optional embodiment of blade 28 is illustrated in FIGS. 9 and 10. Blade 28' is formed in a manner very similar to that shown in FIGS. 7 and 8 except blade edge 66' is formed with a sharp V-groove 74 to provide sharp edges 76 and 78. Edge 66', instead of being curved as in the previous embodiment, has a long straight portion ending in curved portions 80 and 82. This blade provides a straight sharp edge for increased maneuverability on ice and other hard surfaces.

Figure 11:
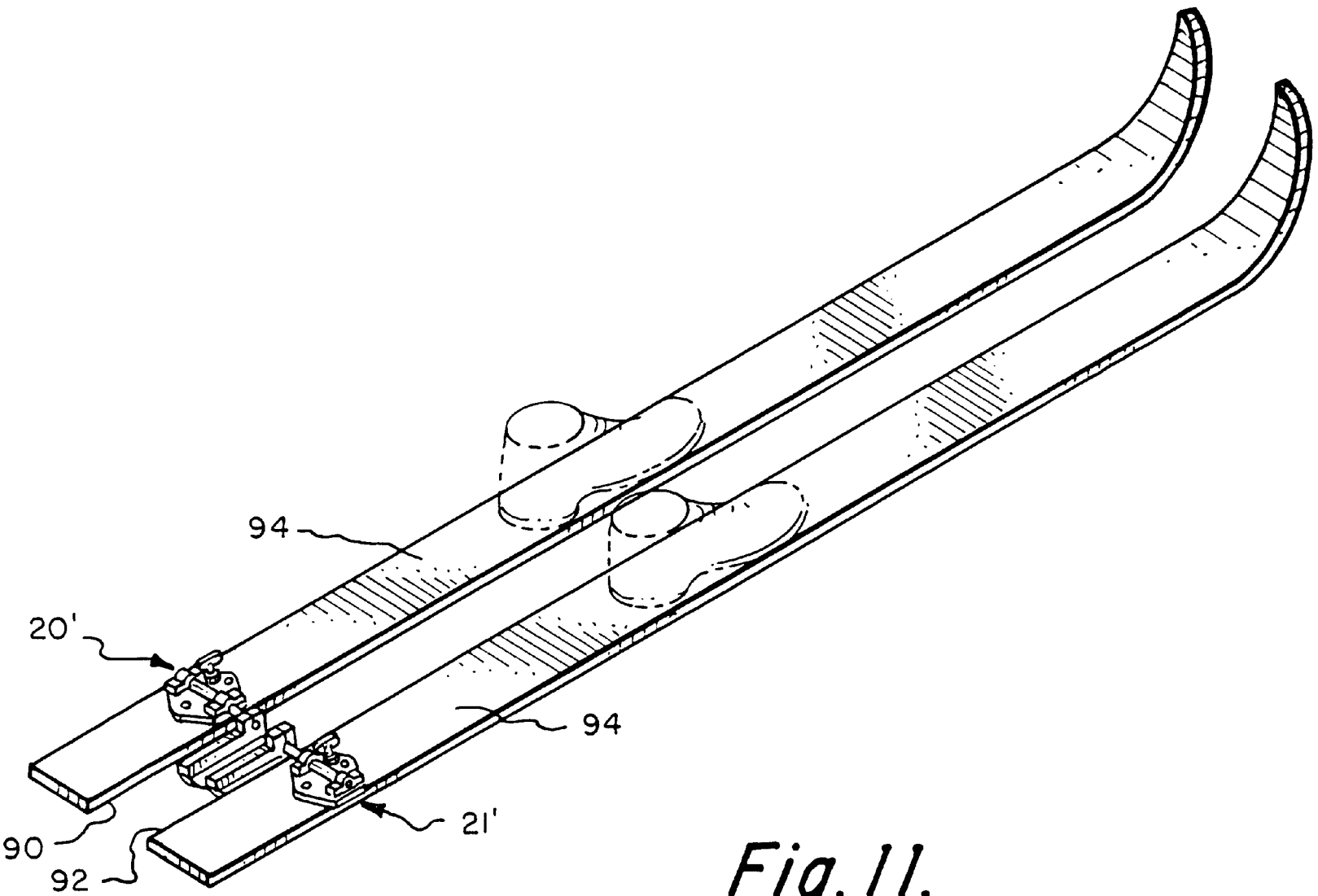
FIG. 11 illustrates the mounting of the skeg device on skis.

The skegs can also be mounted on skis as shown in FIG. 11. A pair of skegs 20, 21 are shown mounted on rear inside edges 90, 92 of skis 94. Of course, this arrangement is only illustrated to show the adaptability and versatility of the skeg device. Other arrangements and configurations are entirely possible.

Thus, there has been disclosed a skeg device and system for installment on a snowboard that improves performance, maneuverability, stability and tracking. A variety of configurations of skegs allow from one, to up to six skegs to be mounted on the forward and rear ends of a snowboard. The configurations possible are from a pair of skegs on opposite sides of the board up to the six skegs shown. Optional configurations may be created by a user and are only limited by their imagination and creativity.

Other options include skeg blades that have rounded edges on various parts of the snowboard and optional skeg blades that have a V-groove sharp edges for maneuvering on ice. All, or only some of these skegs can have the sharp, V-grooved straight edge. Each skeg is spring loaded to allow it to constantly adjust to snow conditions. Each skeg also includes a depth adjustment in the form of a thumbscrew. By simply turning this thumbscrew, a rider can dial in the depth and tracking on each skeg edge. The skegs are designed to fit all types of snowboards, or can even be mounted on skis, and are easily installed with two T-nuts per side. The new cutting edge skegs are the first of their kind to offer riders maximum performance, maneuverability and tracking for snowboards and skis.

This invention is not to be limited by the embodiment shown in the drawings and described in the description which is given by way of example and not of limitation, but only in accordance with the scope of the appended claims.

What is claimed is:

1. A stabilizing skeg device for mounting on snowboards comprising;

a blade;

mounting means mounting said blade on the top rear of and perpendicular to the bottom surface of a snowboard, said mounting means comprising;

a mounting plate;

a shaft rotatable mounted on said mounting plate;

said blade being mounted on an end of said rotatable shaft;

whereby said blade extends below and is movable perpendicular to said bottom surface to stabilize said snowboard on snow.

2. The device according to claim 1 in which said shaft is a cylindrical shaft; said shaft support means comprising a pair of shaft supports having sockets for receiving said cylindrical shaft.

3. The device according to claim 2 including adjusting means for adjusting the depth of said skeg blade beneath said snowboard.

4. The device according to claim 3 in which said adjusting means comprises adjustable means for adjustably rotating said shaft to raise or lower said blade.

5. The device according to claim 4 in which said adjustable means comprises a flange attached to said shaft;

a threaded hole in said flanges a thumbscrew threaded into said threaded hole engaging the surface of said mounting plate whereby rotation of said thumbscrew raises or lowers said flange to raise or lower said skeg blade.

6. The device according to claim 5 in which said cylindrical shaft has a flat sided portion; said flange being attached to one of said flat sides to adjust said shaft.

7. The device according to claim 6 including biasing means for retractably biasing said blade in an extended position whereby said skeg blade can automatically adjust to snow conditions.

8. The device according to claim 7 in which said biasing means comprises; a coil spring wrapped around said cylindrical shaft; one end of said coil spring engaging said shaft.

9. The device according to claim 8 in which said shaft is attached to said blade by clamp means; whereby said blade may be easily removed for repair of replacement.

10. The device according to claim 9 in which said clamp means comprises a split boss on said blade; a hole in said split boss for receiving said shaft; and a hex screw threaded through said split boss for tightening and securely clamping said split boss on said cylindrical shaft.

11. An improved snowboard comprising;

a plurality of stabilizing skeg devices according to claim 14 attached to said snowboard.

12. The improved snowboard according to claim 11 in which said plurality of stabilizing skeg devices comprise at least two of said skeg devices; one at each end of said snowboard.

13. The improved snowboard according to claim 11 in which said plurality of stabilizing skeg devices comprises four stabilizing skeg devices of one each on opposite sides of a forward and rearward ends of said snowboard.

14. The improved snowboard according to claim 11 in which said plurality of stabilizing skeg devices comprises six stabilizing skeg devices; one each at opposite sides at forward and rear ends of said snowboard, and one each at the center of forward and rear end extending through slots in said snowboard.

* * * * *